US011615774B2

(12) United States Patent
Squartini et al.

(10) Patent No.: US 11,615,774 B2
(45) Date of Patent: Mar. 28, 2023

(54) GENERATION SYSTEM OF SYNTHESIZED SOUND IN MUSIC INSTRUMENTS

(71) Applicants: VISCOUNT INTERNATIONAL S.P.A., Mondaino (IT); UNIVERSITA' POLITECNICA DELLE MARCHE, Ancona (IT)

(72) Inventors: Stefano Squartini, Ancona (IT); Stefano Tomassetti, Corinaldo (IT); Leonardo Gabrielli, Osimo (IT)

( * ) Notice: Subject to any disclaimer, the term of this patent is extended or adjusted under 35 U.S.C. 154(b) by 275 days.

(21) Appl. No.: 17/266,216

(22) PCT Filed: Jul. 18, 2019

(86) PCT No.: PCT/EP2019/069339
§ 371 (c)(1),
(2) Date: Feb. 5, 2021

(87) PCT Pub. No.: WO2020/035255
PCT Pub. Date: Feb. 20, 2020

(65) Prior Publication Data

US 2021/0312898 A1 Oct. 7, 2021

(30) Foreign Application Priority Data

Aug. 13, 2018 (IT) ..... 102018000008080

(51) Int. Cl.
*G10H 7/00* (2006.01)
*G10H 5/00* (2006.01)
*G10H 7/12* (2006.01)

(52) U.S. Cl.
CPC ..... *G10H 5/007* (2013.01); *G10H 7/006* (2013.01); *G10H 7/12* (2013.01);
(Continued)

(58) Field of Classification Search
CPC ..... G10H 2250/31; G10H 2240/131; G10H 2240/325; G10H 7/00; G10H 1/0033;
(Continued)

(56) References Cited

U.S. PATENT DOCUMENTS 5,880,392 A 3/1999 Wessel
7,442,869 B2 10/2008 Zinato
(Continued)

FOREIGN PATENT DOCUMENTS

GB 2491722 A * 12/2012 ..... G06F 16/683
WO WO-2020035255 A1 * 2/2020 ..... G10H 5/007
WO WO-2022160054 A1 * 8/2022

OTHER PUBLICATIONS

International Search Report for corresponding PCT/EP2019/069339, dated Aug. 14, 2019.
(Continued)

*Primary Examiner* — Marlon T Fletcher
(74) *Attorney, Agent, or Firm* — Egbert, McDaniel & Swartz, PLLC

(57) ABSTRACT

A generation system (100) of synthesized sound comprises: a first stage (1), wherein features (F) are extracted from an input raw sound and parameters of said features are evaluated; a second stage (2) wherein the evaluated parameters are used to create a plurality of physical models that are metrically evaluated in order to find the parameters of the best physical model, and a third stage (3) wherein the parameters of the best physical model are perturbed in order to create perturbed physical models and a metric evaluated of the perturbed physical models is performed to find the parameters of the best physical model.

2 Claims, 11 Drawing Sheets

(52) U.S. Cl.
CPC . *G10H 2210/031* (2013.01); *G10H 2230/061* (2013.01); *G10H 2250/311* (2013.01)

(58) Field of Classification Search
CPC ..... G10H 2210/031; G10H 2220/371; G10H 2240/145; G10H 3/125; G10H 7/12; G10H 7/006; G10H 5/007
See application file for complete search history.

(56) References Cited

U.S. PATENT DOCUMENTS

| | | | | |
|---|---|---|---|---|
| 10,068,557 | B1 * | 9/2018 | Engel | G10H 1/0041 |
| 10,964,299 | B1 * | 3/2021 | Estes | G10H 1/0025 |
| 11,024,275 | B2 * | 6/2021 | Estes | G10H 1/0066 |
| 11,037,538 | B2 * | 6/2021 | Estes | G10H 1/38 |
| 11,138,964 | B2 * | 10/2021 | Ping | G10L 19/018 |
| 2021/0248983 | A1 * | 8/2021 | Balassanian | G10H 1/0066 |
| 2022/0059063 | A1 * | 2/2022 | Balassanian | G06N 3/088 |
| 2022/0172638 | A1 * | 6/2022 | Aharonson | G09B 15/00 |

OTHER PUBLICATIONS

Written Opinion of the International Searching Authority for corresponding PCT/EP2019/069339, dated Aug. 14, 2019.

Michael A. Casey, "Understanding Musical Sound with Forward Models and Physical Models", Connection Science,vol. 6, No. 2-3, Jan. 1, 1994 (Jan. 1, 1994), p. 355-371.

Pfalz A et al, "Toward Inverse Control of Physics-Based Sound Synthesis", arxiv.org, Cornell University Library, 201 Olin Library Cornell University Ithaca, NY 14853,Jun. 29, 2017 (Jun. 29, 2017).

Stephen Sinclair, "Sounderfeit: Cloning a Physical Model using a Conditional Adversarial Autoencoder", arxiv.org, Cornell University Library, 201 Olin Library Cornell University Ithaca, NY 14853,Jun. 25, 2018 (Jun. 25, 2018).

Jesse Engel et al, "Neural Audio Synthesis of Musical Notes with WaveNet Autoencoders", arxiv.org, Cornell University Library, 201 Olin Library Cornell University Ithaca, NY 14853,Apr. 5, 2017 (Apr. 5, 2017).

* cited by examiner compute $\hat{s}_0[n] = f(\boldsymbol{\theta_0})$;
evaluate $d_0 = \sum_l b_l J_l(s[n], \hat{s}_0[n])$;
while $d_i < \epsilon$ *OR* *maximum iteration reached* *OR* $p$ *iterations reached* do
  $\boldsymbol{\theta_i}$ := random perturbation of $\boldsymbol{\theta_b}$ weighted by $d_b$;
  compute $\hat{s}_i[n] = f(\boldsymbol{\theta_i})$;
  evaluate $d_i = \sum_l b_l J_l(s[n], \hat{s}_i[n])$;
  if $d_i < d_{i-1}$ then
    $\boldsymbol{\theta_b} := \boldsymbol{\theta_i}$;
    $d_b := d_i$
  end
end

FG. 7

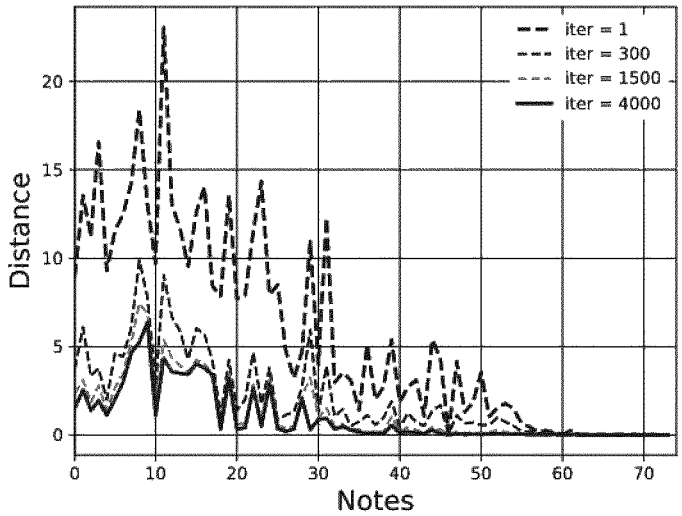

FIG. 8

GENERATION SYSTEM OF SYNTHESIZED SOUND IN MUSIC INSTRUMENTS

The present invention relates to a generation system of synthesized sound in music instruments, in particular a church organ. A parameterization of a physical model is used to generate a synthesized sound. The invention relates to a parameterization system of a physical model used to generate a sound.

A physical model is a mathematical representation of a natural process or phenomenon. In the present invention, the modeling is applied to an organ pipe, thus obtaining a faithful physical representation of a music instrument. Such a methodology permits to obtain a music instrument capable of reproducing not only the sound, but also the associated sound generation process.

U.S. Pat. No. 7,442,869, in the name of the same Applicant, discloses a reference physical model for a church organ.

However, it must be considered that a physical model is not strictly connected to the generation of sounds and to the use in music instruments, but it can also be a mathematical representation of any system from the real world.

The parameterization methods of physical models according to the prior art are mostly heuristic and the sound quality largely depends on the music taste and experience of the Sound Designer. In view of the above, the character and the composition of the sounds are typical of the Sound Designer. Moreover, considering that parameterization occurs in human time, on the average the sounds have long realization periods.

Several methods for the parameterization of physical models are known in literature, such as in the following documents:

Carlo Drioli and Davide Rocchesso. A generalized musical-tone generator with application to sound compression and synthesis. In Acoustics, Speech, and Signal Processing, 1997 IEEE International Conference, volume 1, pages 431-434. IEEE, 1997.

Katsutoshi Itoyama and Hiroshi G Okuno. Parameter estimation of virtual musical instrument synthesizers. In Proc. of the International Computer Music Conference (ICMC), 2014.

Thomas J Mitchell and David P Creasey. Evolutionary sound matching: A test methodology and comparative study. In Machine Learning and Applications, 2007. ICMLA 2007. Sixth International Conference, pages 229-234. IEEE, 2007.

Thomas Mitchell. Automated evolutionary synthesis matching. Soft Computing, 16(12):2057-2070, 2012.

Janne Riionheimo and Vesa Valimaki. Parameter estimation of a plucked string synthesis model using a genetic algorithm with perceptual fitness calculation. EURASIP Journal on Advances in Signal Processing, 2003(8), 2003.

Ali Taylan Cemgil and Cumhur Erkut. Calibration of physical models using artificial neural networks with application to plucked string instruments. Proc. Intl. Symposium on Musical Acoustics (ISMA), 19:213-218, 1997.

Alvin W Y Su and Liang San-Fu. Synthesis of plucked-string tones by physical modeling with recurrent neural networks. In Multimedia Signal Processing, 1997. IEEE First Workshop, pages 71-76. IEEE, 1997.

However, these documents disclose algorithms that refer to given physical models or to some parameters of the physical models.

Publications on the use of neural networks are known, such as: Leonardo Gabrielli, Stefano Tomassetti, Carlo Zinato, and Stefano Squartini. Introducing deep machine learning for parameter estimation in physical modeling. In Digital Audio Effects (DAFX), 2017. Such a document discloses an end-to-end approach (using Convolutional Neural Networks) that embeds an extraction of acoustic features learned from the neural network in the layers of the neural network. However, such a system is impaired by the fact that it is not suitable for being used in a music instrument.

The purpose of the present invention is to eliminate the drawbacks of the prior art, by disclosing a generation system of synthesized sound in music instruments that can be extended to multiple physical models and is independent from the intrinsic structure of the physical model used in its validation.

Another purpose is to disclose such a system that allows for developing and using objective acoustic metrics and iterative optimization heuristic processes, capable of exactly parameterizing the selected physical model according to a reference sound.

These purposes are achieved according to the invention with the characteristics of the independent claim 1.

Advantageous embodiments of the invention appear from the dependent claims.

The generation system of synthesized sound in music instruments according to the invention is defined in claim 1.

Additional features of the invention will appear manifest from the detailed description below, which refers to a merely illustrative, not limiting embodiment, as illustrated in the appended figures, wherein.

Figure 5A:
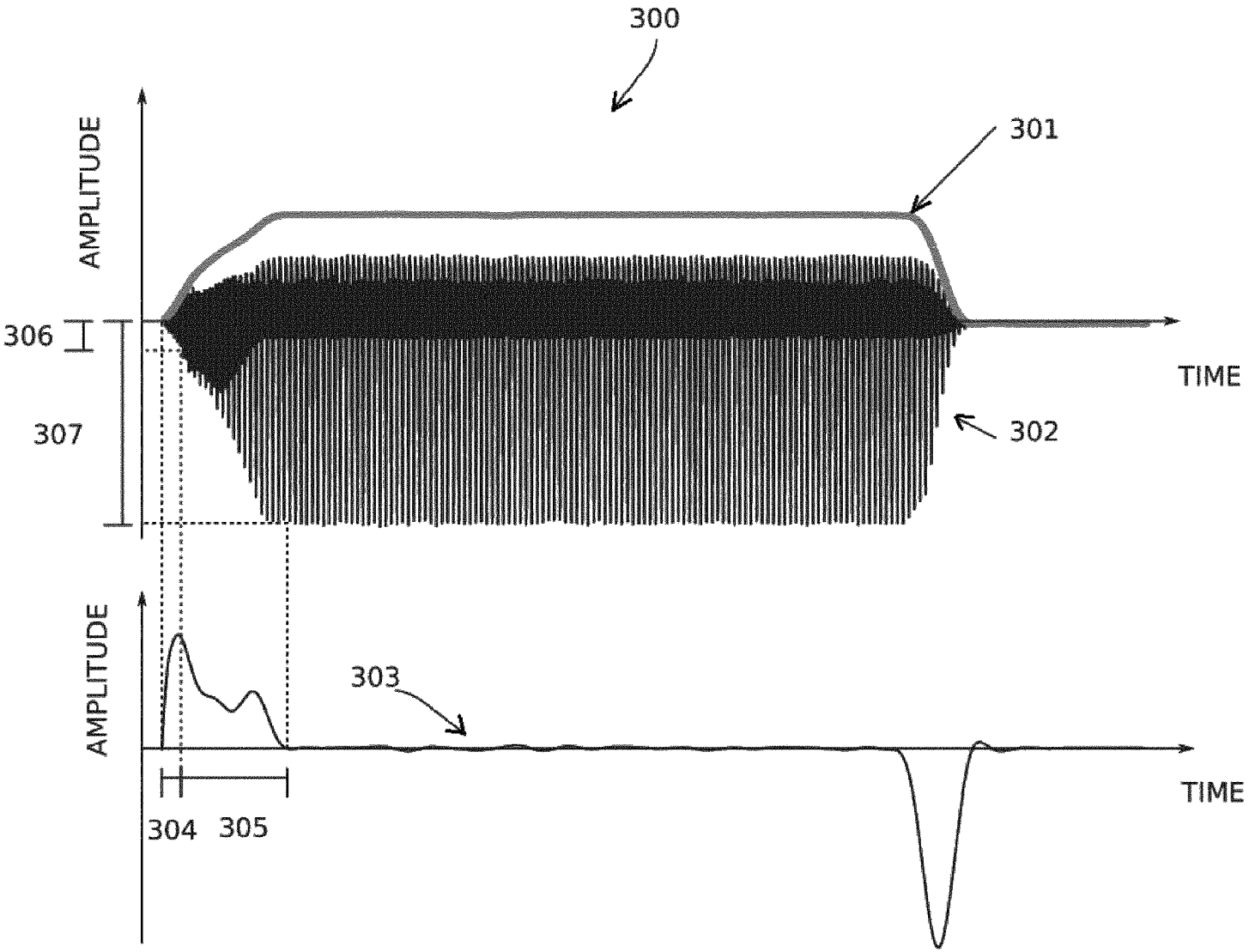
FIG. 5A shows two charts that respectively show the envelope and its derivative for extracting the attack of the waveform.
Figure 5B:
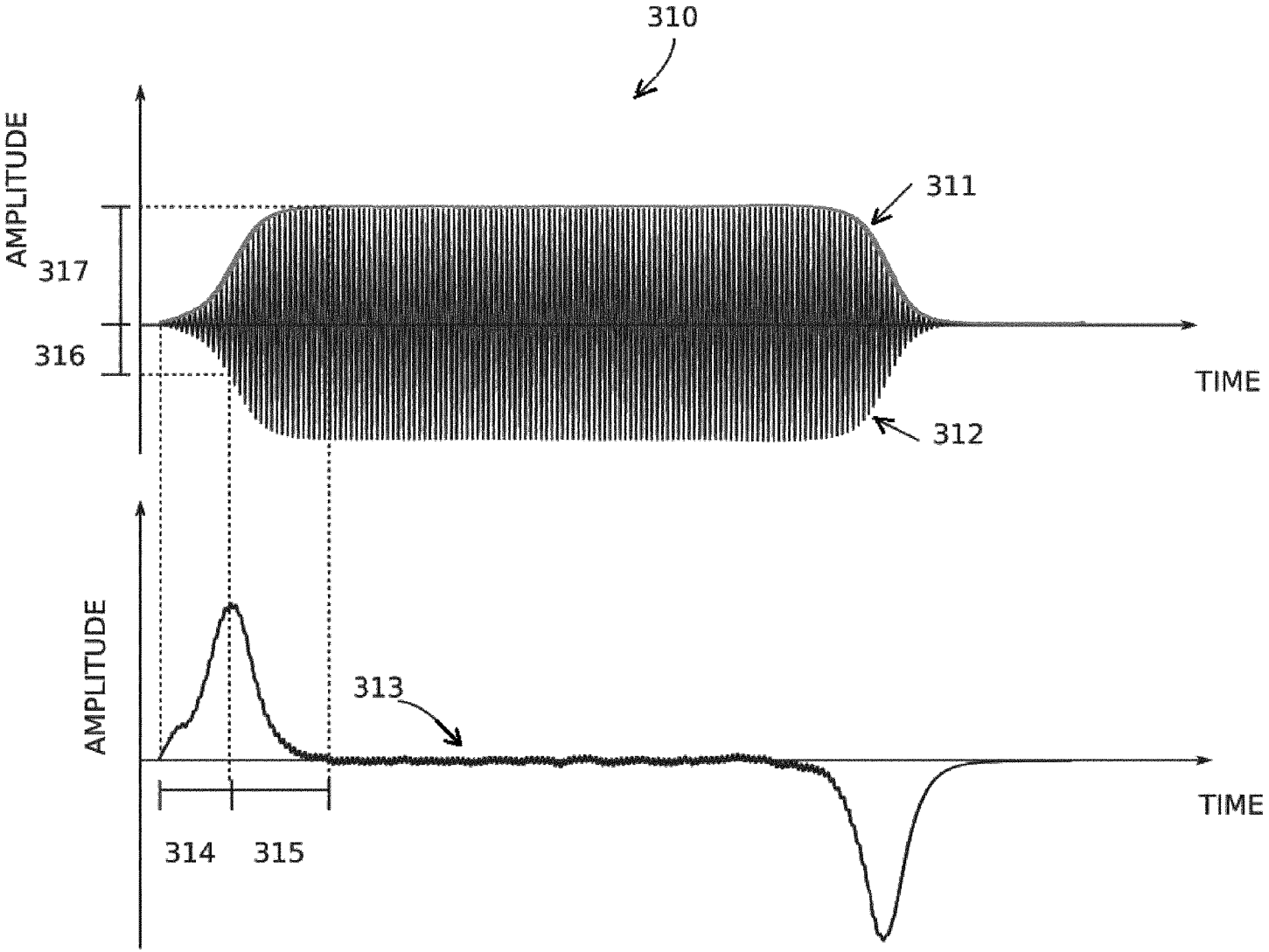
Figure 5C:
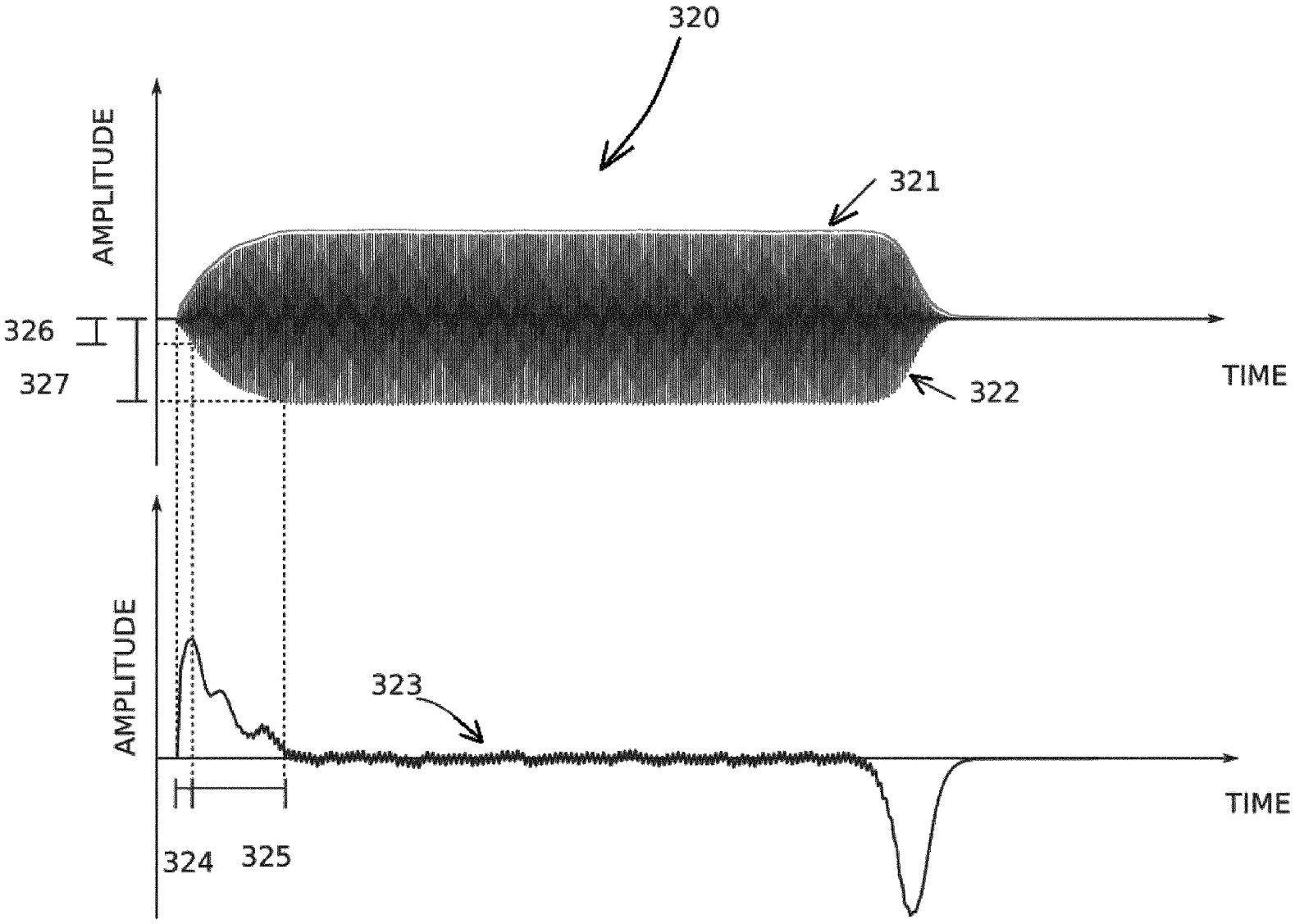
Figure 6A:
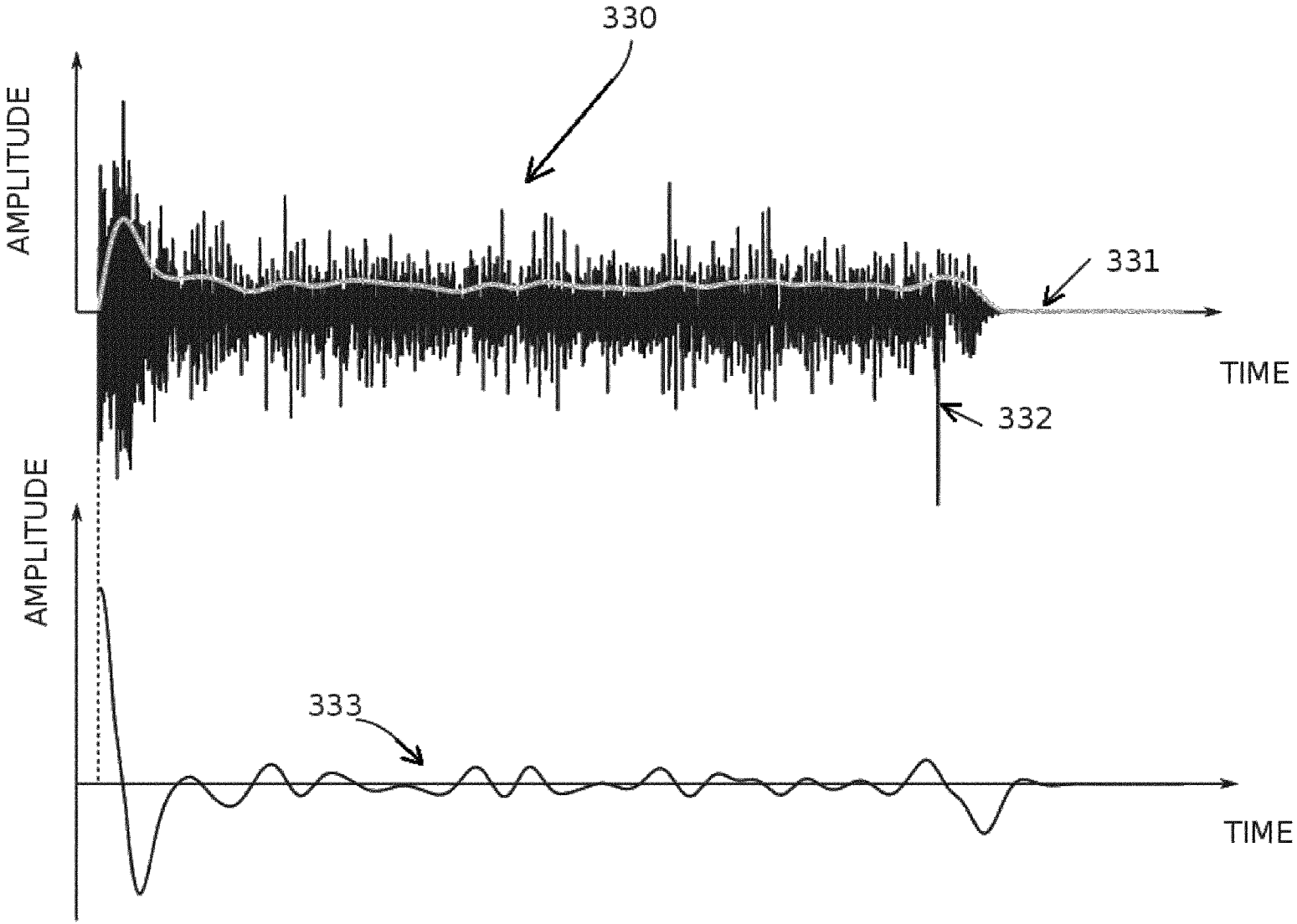
Figure 6B:
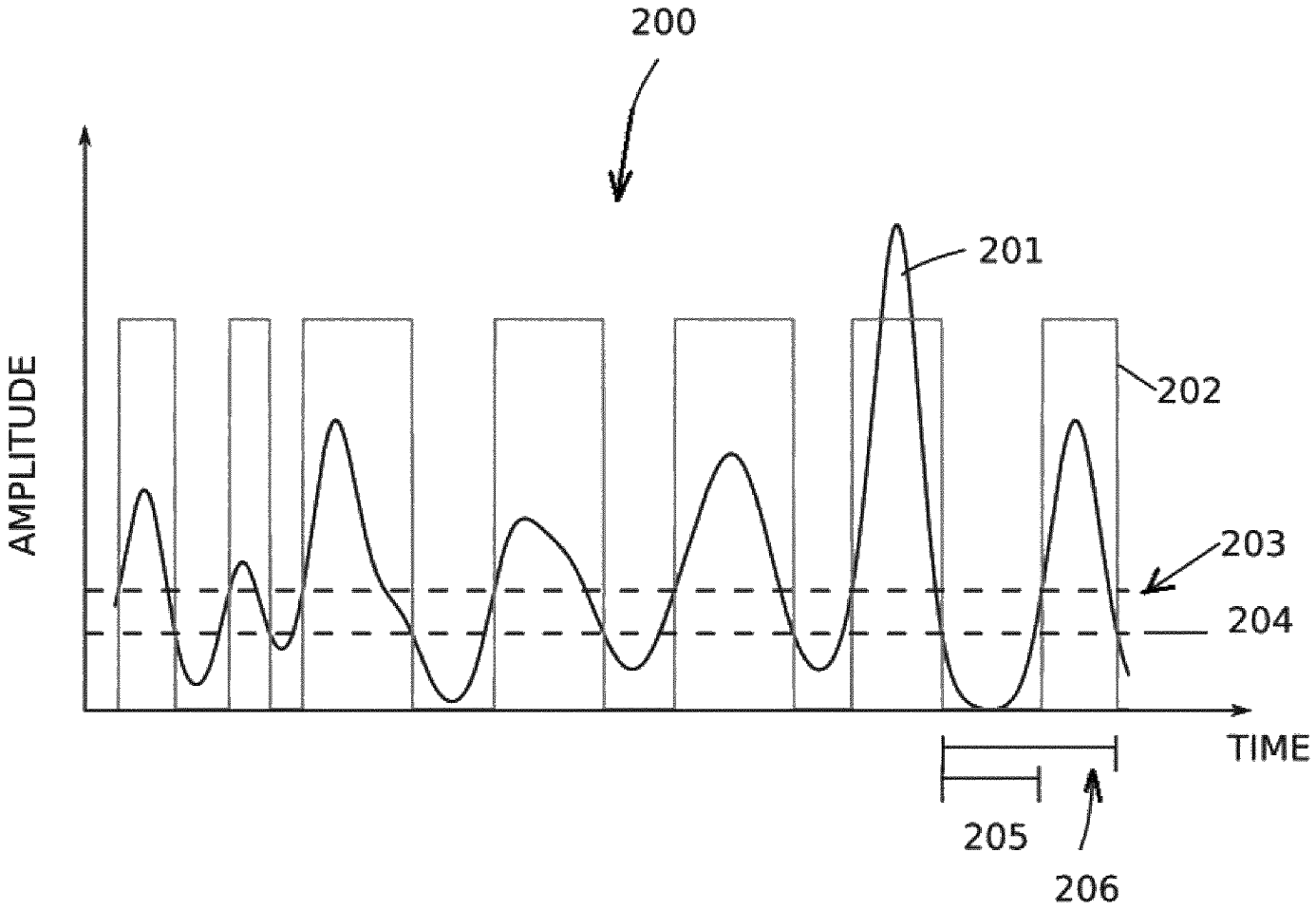

FIG. 5B shoes two charts that respectively show the envelope of the first harmonic and its derivative for extracting the attack of the first harmonic of the signal under examination;

FIG. 5C shows two charts that respectively show the envelope of the second harmonic and its derivative for extracting the attack of the second harmonic of the signal under examination;

FIG. 6A are two charts that respectively show the noise that is extracted by filtering the harmonic part and derivative of the envelope;

FIG. 6B is a chart that shows an extraction of the noise granularity;

FIG. 7 is a formulation of MORIS algorithm;

FIG. 8 is a chart that shows an evolution of the distances on a set of sounds; wherein axis X shows the indexes of the sounds and axis Y shows the total distance values.

With reference to the Figures, the generation system of synthesized sound in music instruments according to the invention is described, which is generally indicated with reference numeral (100).

The system (100) allows for estimating the parameters that control a physical model of music instrument. Specifically, the system (100) is applied to a model of church organ, but can be generally used for multiple types of physical models.

Figure 1:
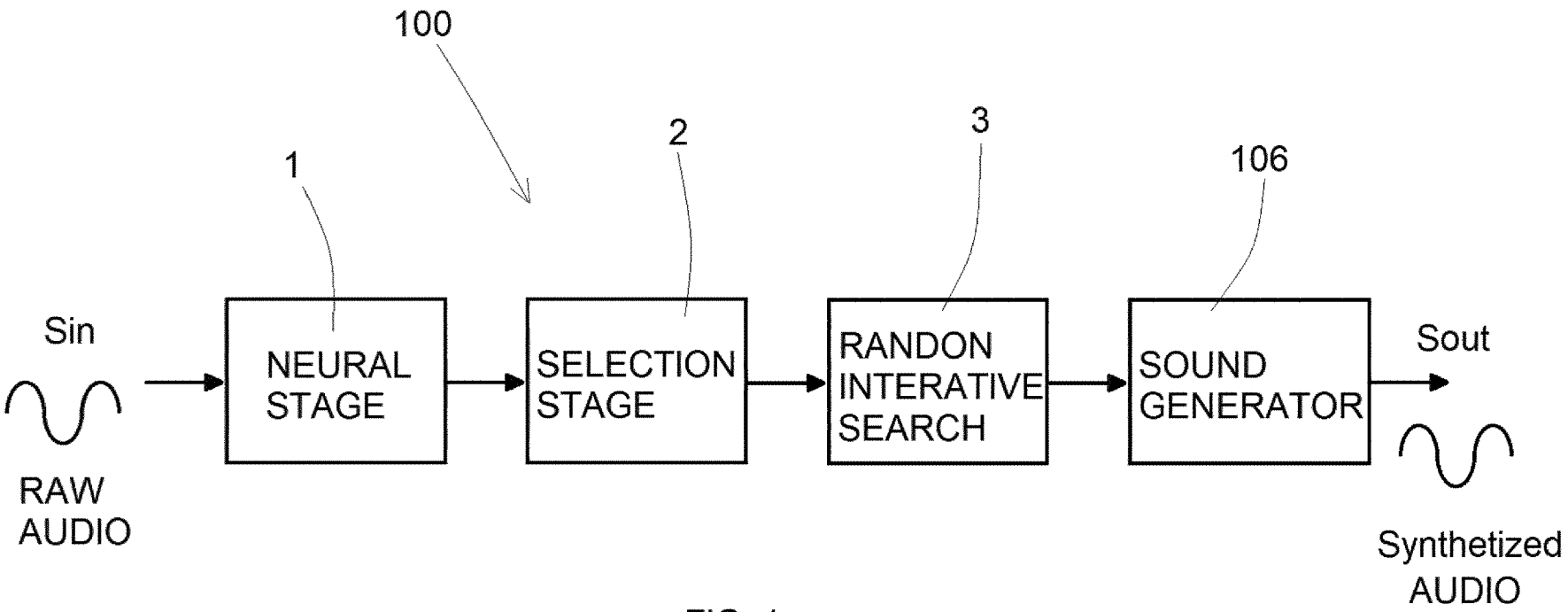
FIG. 1 is a block diagram that diagrammatically shows the sound generation system in music instruments according to the invention.

With reference to FIG. 1, a raw audio signal ($S_{IN}$) enters the system (100) and is processed in such a way to obtain a synthesized audio signal ($S_{OUT}$) that is emitted by the system (100).

Figure 1A:
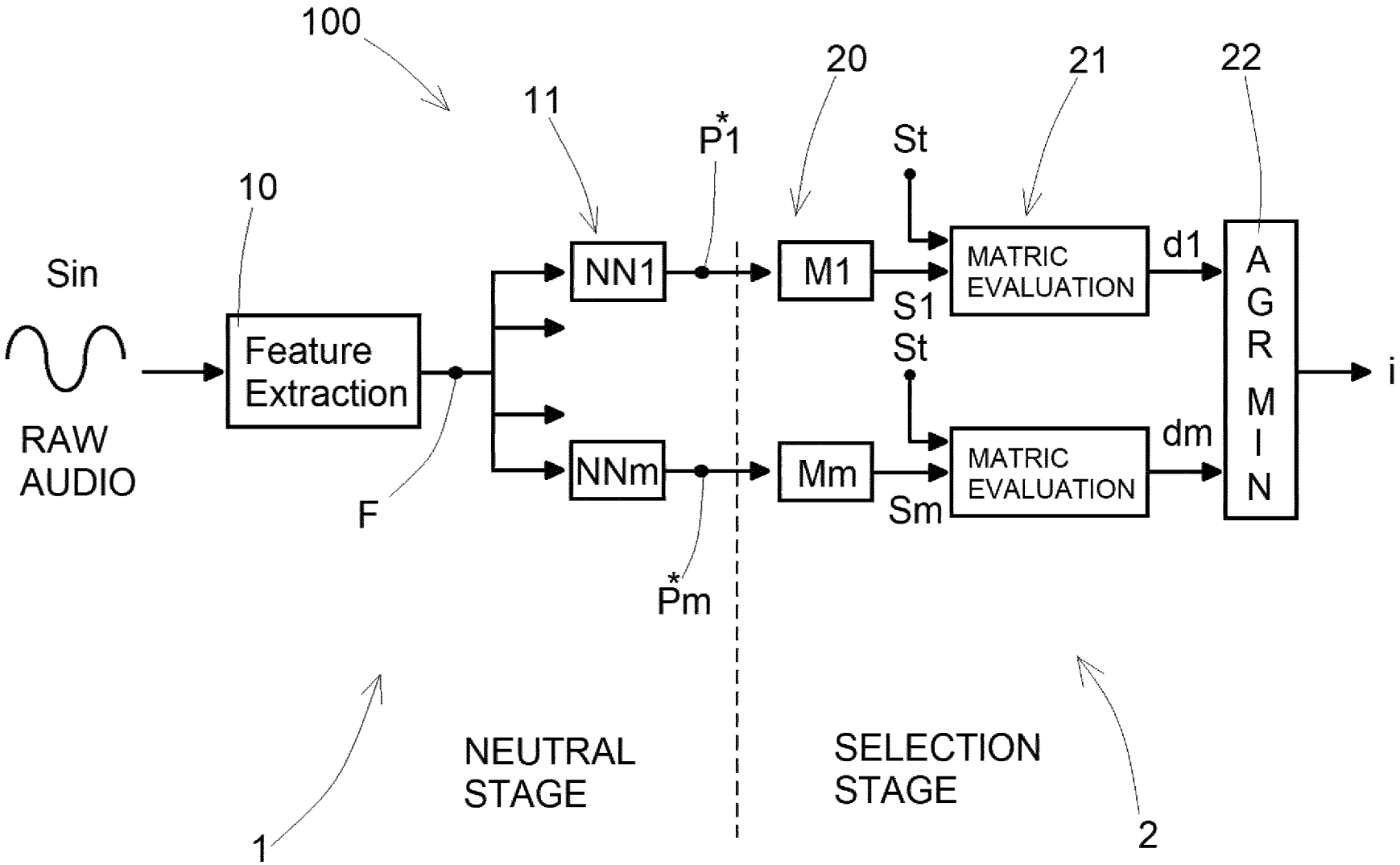
FIG. 1A is a block diagram that shows the first two stages of the system of FIG. 1 in detail.
Figure 1B:
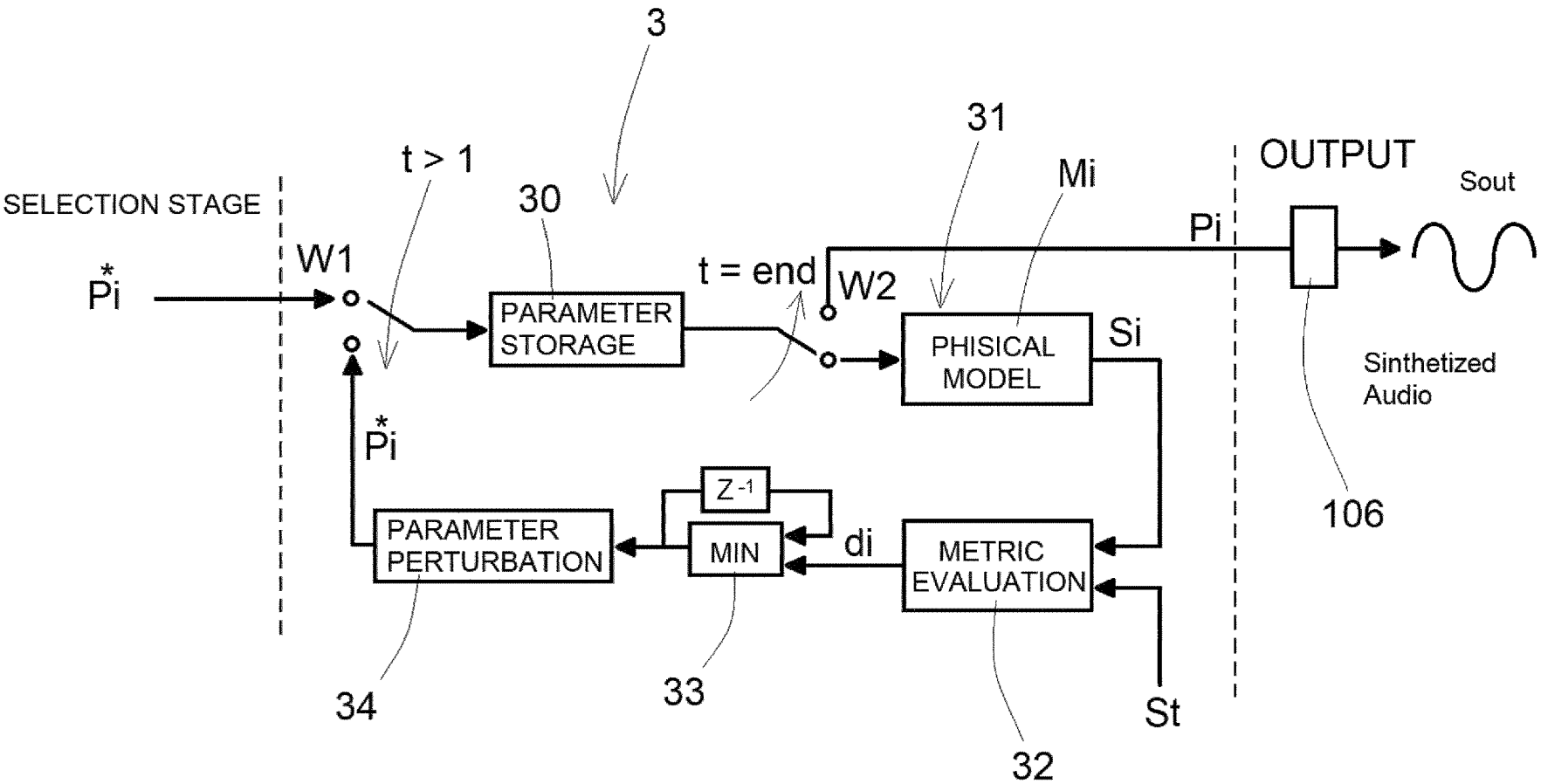
FIG. 1B is a block diagram that diagrammatically shows the last stage of the system of FIG. 1.

With reference to FIGS. 1A and 1B, the system (100) comprises:

- a first stage (1) wherein some features (F) of the raw signal ($S_{IN}$) are extracted and parameters of said features (F) are evaluated, in such a way to obtain a plurality of evaluated parameters ($P^*_1, \ldots P^*_M$);
- a second stage (2) wherein the evaluated parameters ($P^*_1, \ldots P^*_M$) are used to obtain a plurality of physical models ($M_1, \ldots, M_M$) that are evaluated in such a way to select the parameters ($P^*_i$) of the best physical model;
- a third stage (3) wherein the parameters ($P^*_i$) that are selected in the second stage are used to make a random iterative search, in such a way to obtain final parameters ($P_i$) that are sent to a sound generator (106) that emits the synthesized audio signal ($S_{OUT}$).

Figure 2:
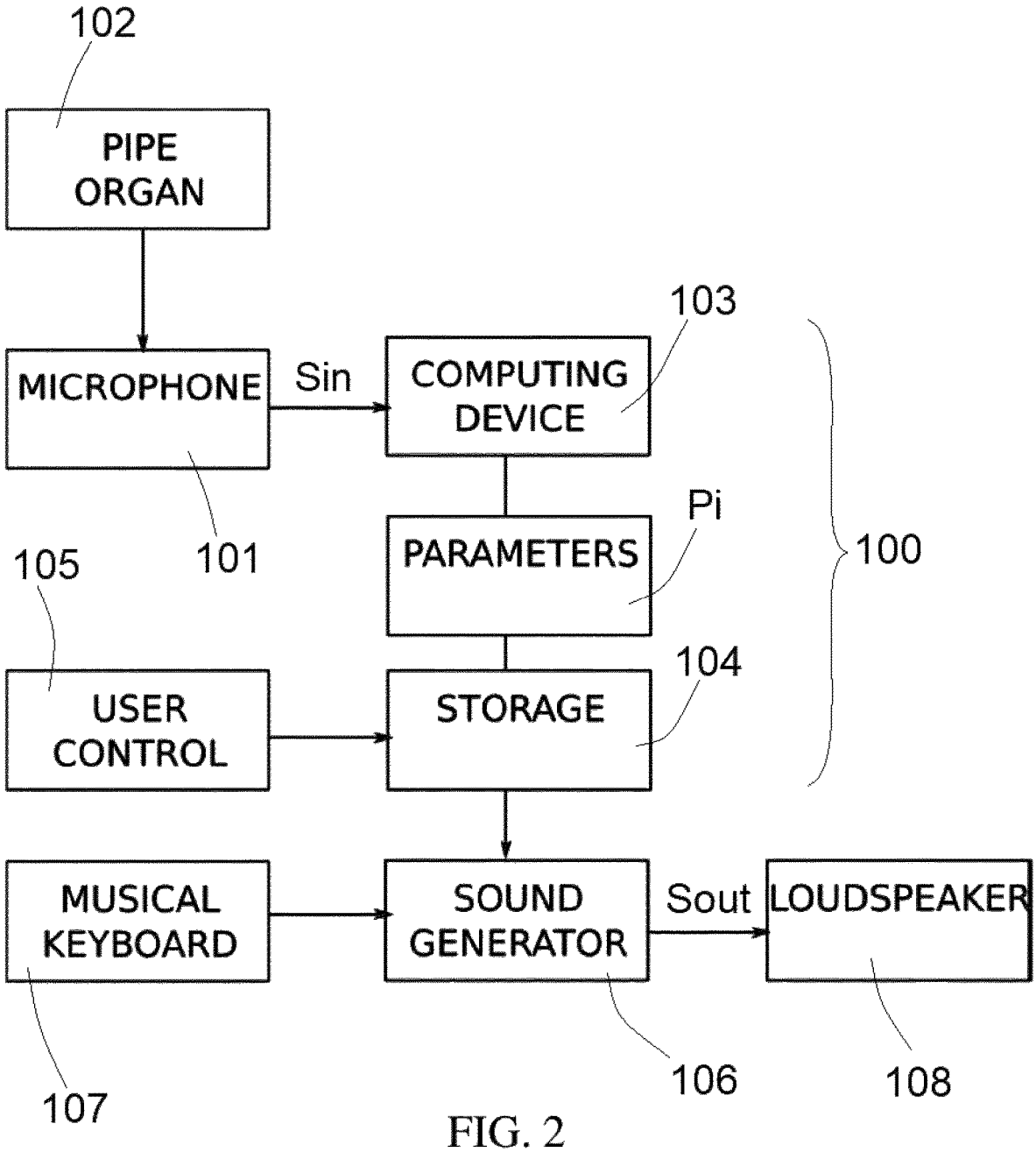
FIG. 2 is a block diagram of the system according to the invention applied to a church organ.

With reference to FIG. 2, the raw audio signal ($S_{IN}$) may come from microphones (101) disposed at the outlet of the pipes (102) of a church organ. The raw audio signal ($S_{IN}$) is acquired by a computing device (103) provided with an audio board.

The raw audio signal ($S_{IN}$) is analyzed by the system (100) inside the computing device (103). The system (100) extracts the final parameters (Pi) for the reconstruction of the synthesized signal ($S_{OUT}$). Said final parameters (Pi) are stored in a storage (104) that is controlled by a user control (105). The final parameters (Pi) are transmitted to a sound generator (106) that is controlled by a musical keyboard (107) of the organ. According to the received parameters, the sound generator (106) generates the synthesized audio signal ($S_{OUT}$) sent to a loudspeaker (108) that emits the sound.

The sound generator (106) is an electronic device capable of reproducing a sound that is very similar to the one detected by the microphone (101) according to the parameters obtained from the system (100). A sound generator is disclosed in U.S. Pat. No. 7,442,869.

First Stage (1)

The first stage (1) comprises extraction means (10) that extract some features (F) from the raw signal ($S_{IN}$) and a set of neural networks (11) that evaluate parameters obtained from said features (F).

The features (F) have been selected based on the organ sound and creating a set of features that is not ordinary and differentiated, it being composed of multiple coefficients relative to different aspects of the raw signal ($S_{IN}$) to be parameterized.

Figure 3:
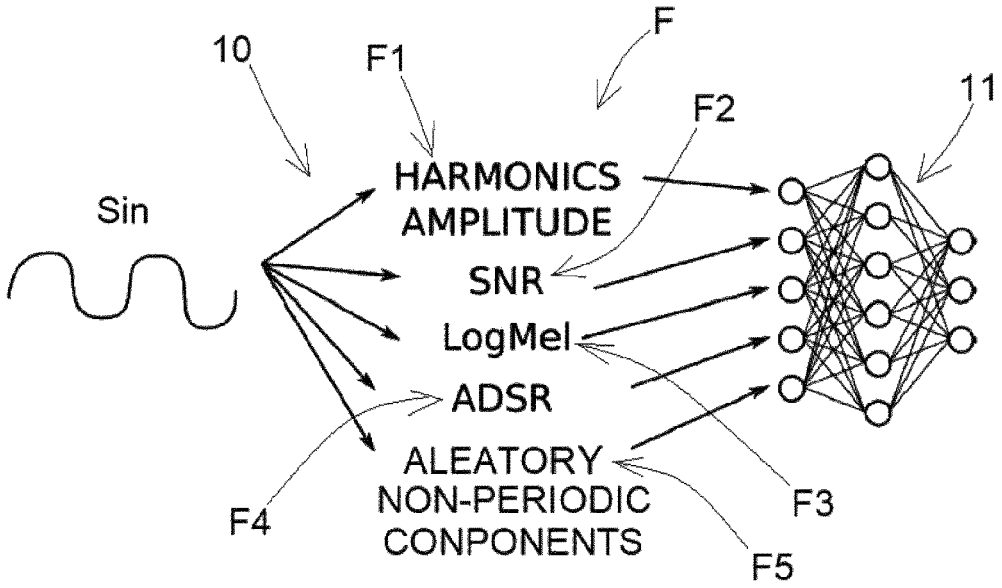
FIG. 3 is a diagram that shows the features extracted from a raw audio signal that is introduced in the system according to the invention.

With reference to FIG. 3, the following features (F) are used:

Amplitude of the first N harmonics (F1): N coefficients relative to the amplitude of the first N harmonics (or partial, if not multiple of the fundamental one) calculated by precisely detecting the peaks in the frequency domain. For example, N=20.

SNR (F2): Signal Noise Ratio calculated as ratio between energy of the harmonics and total energy of the signal.

$$SNR = \frac{HarmRMS}{SignalRMS}$$

Log Mel Spectrum (F3): Log-Mel spectrum calculated in 128 points with a technique according to the prior art.

Coefficients (F4) relative to the envelope: Coefficients relative to the sound attack (A), decay (D), sustain (S) and release (R) time according to the scheme defined as ADSR in music literature and also used in the physical model to generate the sound envelopes (time amplitude trend).

The coefficients are extracted (F4) are extracted through analysis of the envelope of the raw audio signal ($S_{IN}$), i.e. using an envelope detector according to the techniques of the prior art.

Figure 3A:
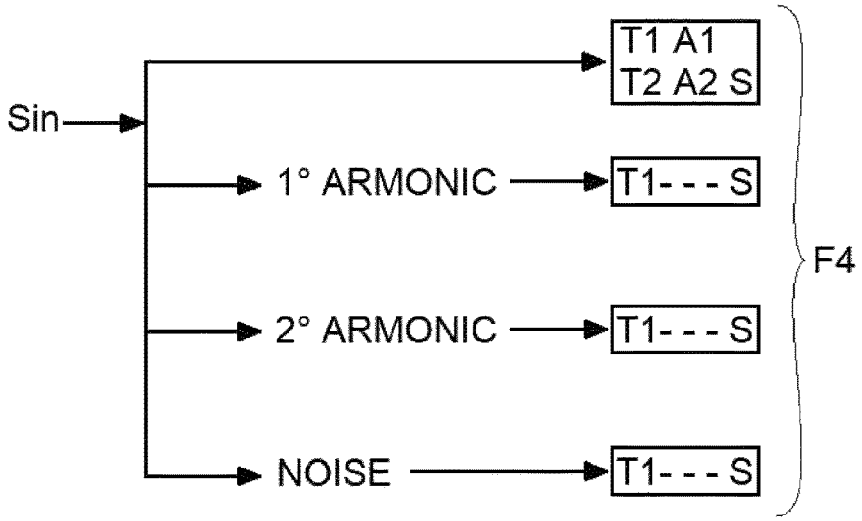
FIG. 3A is a diagram that shows some of the characteristics extracted from the raw audio signal in detail.

With reference to FIG. 3A, 20 coefficients (F4) are extracted because the extraction is made on the raw signal ($S_{IN}$), on the first and the second harmonic (each of them being extracted by filtering the signal with a suitable passband filter) and on the noise component extracted by means of comb filtering to eliminate the harmonic part.

Five coefficients are extracted for every part of signal that is analyzed, such as:

T1 first attack ramp time, from the initial time to the maximum point of the derivative of the enveloped extracted with Hilbert transform of the signal, which is known in the prior art. The division in two attack ramps comes from the use of the physical model indicated in U.S. Pat. No. 7,442,869 that describes the input of the church organ sound, as a composition of two arrack ramps.

A1 amplitude relative to instant T1

T2 second attack ramp time, from T1 to the point where the derivative of the envelope stabilizes its value around 0

A2 amplitude relative to instant T2

S RMS sustain amplitude of the signal after the attack transitory.

Moreover, aleatory and/or non-periodic components (F5) are extracted from the signal. The aleatory and/or non-periodic components (F5) are six coefficients that provide indicative information on the noise. The extraction of these components can also be done through a set of comb and notch filtering to remove the harmonic part of the raw signal (Si). The extracted useful information can be: the RMS vale of the aleatory component, its duty cycle (defined as noise duty cycle), the zero crossing rate, the zero crossing standard deviation and the envelope coefficients (attacks and sustain).

FIG. 5A shows two charts that respectively show the envelope and its derivative for extracting the attack of the waveform. FIG. 5A shows the following features of the signal, which are indicated with the following numbers:

300 Time waveform chart of the raw sound and its temporal envelope

301 Average temporal development of the signal

302 Time waveform of the signal

303 Derivative of the signal envelope over time

304 T1 time instant relative to the first attack ramp

305 T2 time instant relative to the second attack ramp

306 A1 amplitude of the waveform in correspondence of time T1

307 A2 amplitude of the waveform in correspondence of time T2.

FIG. 5B shows two charts that respectively show the envelope and its derivative for extracting the attack of the first harmonic of the signal under examination. FIG. 5B shows the following features of the first harmonic of the signal, which are indicated with the following numbers:

310 Time waveform chart relative to the first harmonic, and its temporal envelope

311 Average temporal envelope of the first harmonic

312 Time waveform of the first harmonic

313 Time derivative of the first harmonic envelope

314 T1 time instant relative to the first attack ramp of the first harmonic

315 T2 time instant relative to the second attack ramp of the first harmonic

316 A1 waveform amplitude in time T1 of the first harmonic

317 A2 waveform amplitude in time T2 of the first harmonic.

FIG. 5C shows two charts that respectively show the envelope and its derivative for extracting the attack of the second harmonic of the signal. FIG. 5C shows the following features relative to the signal second harmonic, which are indicated with the following numbers:

320 Time waveform chart relative to the second harmonic, and its temporal envelope

321 Average temporal envelope of the second harmonic

322 Time waveform of the second harmonic

323 Time derivative of the second harmonic envelope

324 T1 time instant relative to the first attack ramp of the second harmonic

325 T2 time instant relative to the second attack ramp of the second harmonic

326 A1 waveform amplitude in time T1 of the second harmonic

327 A2 waveform amplitude in time T2 of the second harmonic.

FIG. 6A shows two charts that respectively show the noise that is extracted by filtering the harmonic part and derivative of the envelope. FIG. 6A shows the following features of the signal aleatory component, which are indicated with the following numbers:

330 Time waveform chart relative to the noise component, and its temporal envelope

331 Average temporal envelope of the noise component

332 Time waveform of the noise component

333 Time derivative of the noise component envelope.

FIG. 6B shows a chart that shows an extraction of the noise granularity. FIG. 6B is a representation (200) of a noise waveform for which the granularity analysis is performed.

The time waveform relative to the aleatory part is shown in 201. The Ton and Toff analysis wherein the noise manifests its granularity characteristics is performed through two guard thresholds (203, 204) based on the techniques of the prior art. Such an analysis makes it possible to observe a square waveform with variable Duty-Cycle shown in 202. It must be noted that the square wave (202) does not correspond to a real waveform that is present in the sound, but it is a conceptual representation for the analysis of the intermittence and granularity features of the noise, which will be performed using the Duty-Cycle feature of said square wave.

The chart of FIG. 6B shows a time interval where the noise is null, defined as Toff (205). Numeral (206) indicates the entire noise period with a complete "on-off" cycle, and consequently a noise intermittence period. The ratio between the time with noise and the time without noise is analyzed, similarly to the calculation of a Duty Cycle with a pair of guard thresholds. The noise granularity is obtained by making the average of a suitable number of periods.

Since the noise of the organ is amplitude modulated, there will be a phase within a period wherein the noise is practically null, which is defined as Toff (205), as shown in FIG. 6B. This piece of information is contained in the noise duty cycle coefficient.

The four coefficients that characterized the noise are:

Noise Duty Cycle: calculated as the ratio between Toff (205) and the entire period time (206).

Zero Crossing Rate: average number of zero crossings in 1 period, averaged for a number of periods equal to 1 second. It expresses an average frequency of the aleatory part.

Zero Crossing Standard Deviation: it corresponds to the standard deviation of the average number of zero crossings evaluated in the measurement of the zero crossing rate for each period.

RMS noise: Root Mean Square of the aleatory component, calculated on 1 second.

After extracting the features (F) from the raw signal ($S_{IN}$), the parameters of said features are evaluated by a set of neural networks (11) that operate in parallel on the same sound to be parameterized, estimating parameters that are slightly different for each neural network because of small differences of each network.

Every neural network takes input features (F) and provides a complete set of parameters ($P^*_1, \ldots P^*_M$) that are suitable for being sent to a physical model to generate a sound.

The neural networks can be of all the types included in the prior art that accept pre-processed input features (Multi-Layer Perceptron, Recurrent Neural Networks, etc.).

The number of neural networks (11) can change, generating multiple evaluations of the same features made by different networks. The evaluations will differ in acoustic accuracy and this will require the use of the second stage (2) to select the best physical model. The evaluations are all made on the entire set of features, the acoustic accuracy is evaluated by the second stage (2) that selects the set of parameters that are evaluated by the best performing neural networks.

Although the following description specifically refers to a type of Multi-Layer Perceptron (MLP) network, the invention is also extended to different types of neural network. In an MLP network, every layer is composed of neurons.

Figure 4:
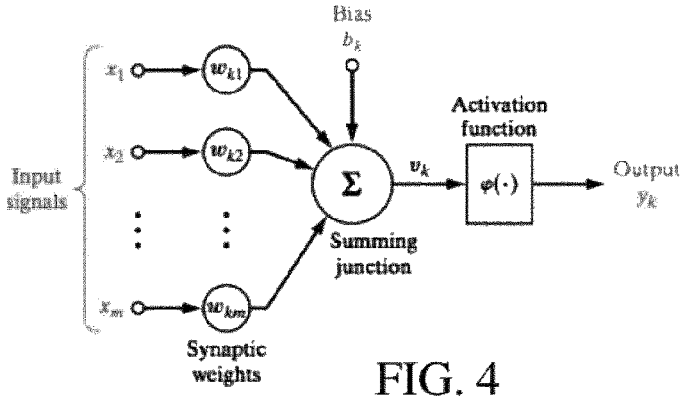
FIG. 4 is a diagram of an artificial neuron, at the base of MLP neural networks used in the system according to the invention.

With reference to FIG. 4, the mathematical description of the k-th neuron follows:

$$u_k = \sum_{j=1}^{m} w_{kj} x_j$$

$$y_k = (u_k + b_k)$$

wherein:

$x_1$; $x_2$; $x_m$ are the inputs, which in the case of the first stage are the features (F) extracted from the raw signal ($S_{IN}$)

$w_{k1}$; $w_{k2}$; $w_{km}$ are the weights of each input $u_k$ is the linear combination of the inputs with the weights $b_k$ is the bias ( ) is the activation function (non-linear)

$y_k$ is the output of the neuron.

The use of MLP is given by the characteristics of training simplicity and by the speed that can be reached during the test. These characteristics are necessary given the use in parallel of a rather large number of neural networks. Another fundamental characteristic is the possibility to make hand-crafting of the features, i.e. the audio characteristics that permit to use the knowledge of the sounds to be evaluated.

It must be considered that with an MLP neural network the extraction of the features (F) is made ad-hoc with DSP algorithms, achieving a better performance compared to an end-to-end neural network.

The MLP network is trained by using an error minimization algorithm according to the prior art of the error backpropagation. In view of the above, the coefficients of each neuron (weights) are iteratively modified until the optimum condition is found, which permits to obtain the lowest error with the dataset used during the training step.

The used error is the Mean Squared Error that is calculated on the coefficients of the physical model normalized in the range [−1; 1]. The network parameters (number of layers, number of neurons per layer) were explored with a random search in the ranges given in table 1.

TABLE 1

Hyperparameter range.

| Network layout | Layers sizes | Activations |
|---|---|---|
| Fully Connected layers: 2, 3, l4, . . . , 12 | $2^i$, 5 < i < 12 | tanh or ReLU |
| Training epochs | Batch size | Optimizer parameters (SGD, Adam, Adamax) |
| 20000, 2000 patience | 10 to | learning rate = $10^i$, −8 < i − 2 |
| Validation split = 10% | 2000 | MomentumMax = 0.8, 0.9 |

The training of the neural network is made according to the following steps:

Forward Propagation

1. Forward propagation and output generation $y_k$
2. Cost function calculation $E=\frac{1}{2}\Sigma\|y-y'\|^2$
3. Error backpropagation to generate the delta to be applied in order to update the weights for each training epoch Weight Update 1. The error gradient is calculated relative to the weights $$\frac{\partial E^2}{\partial w_{ij}}$$

2. The weights are updated as follows:

$$w_{ij}^k = w_{ij}^{k-1} - \frac{\partial E^2}{\partial w_{ij}}$$

where is the learning rate

A dataset of audio examples must be provided for learning. Each audio example is associated with a set of parameters of the physical model that are necessary to generate the audio example. Therefore, the neural network (11) learns how to associate the features of the sounds with the parameters that are necessary to generate them.

These sound-parameter pairs are obtained, generating sounds through the physical model, providing input parameters and obtaining the sounds associated with them.

Second Stage (2)

The second stage (2) comprises construction means of the physical model (11) that use the parameters ($P^*_1$, . . . $P^*_M$) evaluated by the neural networks to build physical models ($M_1$, . . . $M_M$). Otherwise said, the number of physical models that are built is equal to the number of neural networks used.

Each physical model ($M_1$, . . . $M_M$) emits a sound ($S_1$, . . . $S_M$) that is compared with a target sound ($S_T$) by means of metric evaluation means (21). An acoustic distance ($d_1$, . . . $d_M$) between the two sounds is obtained at the output of each metric evaluation means (21). All acoustic distances ($d_1$, . . . $d_M$) are compared by means of the selection means (22) that select an index (i) relative to the lowest distance in order to select the parameters ($P^*_i$) of the physical model (Mi) with the lowest acoustic distance from the target sound ($S_T$). The selection means (21) comprise an algorithm based on an iteration that individually examines the acoustic distances (d1, . . . $d_M$) generated by the metric evaluation means, in such a way to find the index (i) of the lowest distance in order to select the parameters of said index.

The metric evaluation means (21) are a device used to measure the distance between two tones. The lower the distance is, the more similar the two sounds will be. The metric evaluation means (21) use two harmonic metrics and one metric for the analysis of the temporal envelopes, but this criterion can be extended to all types of usable metrics.

The acoustic metrics permit to objectively evaluate the similarity of two spectra. Variants of the Harmonic Mean Squared Error (HMSE) concept are used. It is the MSE calculated on the peaks of the FFT of the sound ($S_1$, . . . $S_M$) generated by the physical model compared with the target sound ($S_T$), in such a way to evaluate the distance ($d_1$, . . . $d_M$) between homologous harmonics (the first harmonic of the target sound is compared with the first harmonic of the sound generated by the physical model, etc.).

Two comparison methods are possible.

In the first comparison method, the distances between two homologous harmonics are all weighed in the same way.

In the second comparison method, a higher weight is given to the harmonic differences, whose correspondents in the target signal had a higher amplitude. A basic psychoacoustics element is used, according to which the harmonics of the spectrum with higher amplitude are perceived as more important. Consequently the difference between homologous harmonics with the amplitude of the same harmonic in the target sound is multiplied. In this way, if the amplitude of the i-th harmonic in the target sound is extremely low, the importance of the evaluation error of the harmonic in the evaluated signal is reduced. Therefore, in this second comparison method, the importance of the error made on the harmonics, which had a low psychoacoustic importance already in the raw signal ($S_{IN}$) because of reduced intensity, is limited.

Other spectral metrics of the prior art, such as RSD and LSD, are described mathematically below.

In order to evaluate the temporal features, a metrics based on the envelope of the waveform of the raw input signal ($S_{IN}$) is calculated. The difference in square module of the evaluated signal relative to a target is used.

The following metrics are used:

$$H_L = \frac{1}{L}\sum_{i=1}^{L}(S_r(l\omega_0) - S_e(l\omega_0))^2$$

-continued $$H_L^W = \frac{1}{L}\sum_{i=1}^{L}(S_t(l\omega_0) - S_e(l\omega_0))^2 S_t(l\omega_0)$$

wherein subscript L is the number of harmonics taken into consideration, whereas superscript W identifies the HMSE Weighed variant $$E_D = \sum_{n=0}^{T_s}(|\mathcal{H}(s_t[n])| - |\mathcal{H}(s_e[n])|)^2$$

wherein

Ts is the end of the attack transitory,

H is the Hilbert transform of the signal, which is used to extract the envelope, whereas s is the signal over time and S is the module of the signal DFT over time.

$$RSD = \frac{1}{M}\frac{\sum_{m=0}^{M}(S_t(m) - S_e(m))^2}{\sum_{m=0}^{M}(S_t(m))^2}$$

$$LSD(S_1, S_2) = \sqrt{\frac{1}{M}\sum_{m=0}^{M-1}(S_t(m) - S_e(m))^2}.$$

$$WaveformDiff = E[|s_t(t) - s_e(t)|]$$

For the harmonic distance metrics, H (relative to the entire spectrum), $H_{10}$ and $H_{10}^W$ (relative to the first ten harmonics) were used.

For the envelope metrics, $E_D$, E1 and E2 were used, where the number refers to the harmonic whereon the envelope difference is calculated. The sum of the weighed metrics is composed by a weighed sum of the individual metrics, with weights established by the human operator that actuates the process.

The second stage (2) can be implemented by means of an algorithm that comprises the following steps:

1. Selection of first evaluated parameters ($P^*_1$) for the generation of a first physical model ($M_1$) and calculation of a first distance (d1) between the sound ($S_1$) of the first physical model and a target sound ($S_T$).

2. Selection of second evaluated parameters ($P^*_2$) for the generation of a second physical model ($M_2$) and calculation of a second distance (d2) between the sound ($S_2$) of the second physical model and a target sound ($S_T$).

3. The parameters of the second physical model are selected if the second distance (d2) is lower than the first distance (d1), otherwise the parameters of the second physical model are discarded;

4. The steps 4 and 3 are repeated until all evaluated parameters of all physical models generated by the first stage (1) are examined.

Third Stage (3)

The third stage (3) comprises a memory (30) that stores the parameters (P*i) selected by the second stage (2) and physical model creation means (31) which are suitable for building a physical model ($M_i$) according to the parameters ($P^*_i$) selected by the second stage (2) and coming from the memory (30). From the physical model ($M_i$) of the third stage a sound is emitted ($S_i$), which is compared with a target sound ($S_T$) by means of metric evaluation means (32) that are identical to the metric evaluation means (21) of the second stage (2). The metric evaluation means (32) of the third stage calculate the distance ($d_i$) between the sound ($S_i$) of the physical model and the target sound ($S_T$). Such a distance ($d_i$) is sent to selection means (33) suitable for finding a minimum distance between the input distances.

The third stage (3) also comprises perturbation means (34) suitable for modifying the parameters stored in the memory (30) in such a way to generated perturbed parameters ($P'_i$) that are sent to said physical model creation means (31) that create physical models with the perturbed parameters. Therefore, the metric evaluation means (32) find the distances between the sounds generated by the physical models with the perturbed parameters and the target sound. The selection means (33) select the minimum distance between the received distances.

The third stage (3) provides for a step-by-step search that explores the parameters of the physical model randomly, perturbing the parameters of the physical model and generating the corresponding sounds.

A discreetly high number of perturbation passages is necessary, because not all parameters relative to a set will be perturbed at each iteration. The objective is to minimize the value of the metrics used, perturbing the parameters, discarding all parameters sets and keeping only the best parameter set.

The third stage (3) can be implemented by providing:

- a first switch (W1) between the output of the second stage, the input of the memory (30) and the output of the parameter perturbation means (34);
- a second switch (W2) between the output of the memory (30), the input of the physical model creation means (31) and the input of the audio generator, and
- a delay block ($Z^{-1}$) that connects in retraction the output to the input of the selection means (33).

An algorithm can be implemented for the operation of the third stage (3). Such an algorithm works on a normalized range [−1; 1] of the parameters and comprises the following steps:

1. Generation of a sound (Si) relative to the parameters (P*i) of iteration 0 (i.e. the parameters from the second stage (2))

2. Calculation of a first distance of the sound (Si) from a target sound ($S_T$)

3. Perturbation of the parameters (P*i) in such a way to obtain perturbed parameters ($P'_i$)

4. Generation of a sound from the new set of perturbed parameters ($P'_i$)

5. Calculation of a second distance of the sound generated by the perturbed parameters (P") from the target sound.

6. In case of a distance reduction, i.e. the second distance is lower than the first distance, the previous parameter set is discarded, and otherwise is maintained.

7. Repeat the steps 3, 4 and 5 until the end of the process, which will terminate accordingly when one of the following events occurs:

- Achievement of the maximum number of iterations that is set by the user at the beginning of the process;
- Achievement of the maximum number of patience iterations, i.e. without improvements in terms of evaluated objective distance, which was set by the user at the beginning of the process;

Achievement (and/or exceeding) of the minimum error threshold set by the user at the beginning of the process.

The free parameters of the algorithm are as follows:

Number of iterations

Patience iterations: the algorithm is stopped in absence of improvements for a preset number of iterations.

Minimum error threshold for which the algorithm is stopped

Probability of perturbation of the individual parameter

Distance multiplier: multiplication factor used to multiply the value of the distance calculated for the current realization with a random term in order to obtain the entity of the perturbation to be applied to the parameters during the following iteration.

Weights of the metrics: multiplication factors to be applied to the individual metrics in the calculation of the total distance between proposed sound and target sound.

The calculation of the new parameters is made according to the equation:

$$\theta_i = \mu d_i \cdot (\theta_b \circ [r' \circ g])$$

where:

$_b$ is the best parameter set obtained at the moment of the calculation,

<1 is a distance multiplier that is suitably set in order to improve and/or accelerate the convergence of distance at step i, r is a random vector with values [0; 1] of the same dimension as $_b$, g is a random perturbation vector that follows a Gaussian distribution and has the same dimensions as $_b$.

FIG. 7 shows a formulation of the MORIS algorithm. The MORRIS algorithm is based on a random perturbation weighed by the error made at the best previous step $d_b$. Not all parameters are perturbed at every iteration.

FIG. 8 shows an evolution of the distances of the parameter set relative to a sound target, which shows that, with the progress of iterations, the distance between the parameter set and the target is reduced, at progressively smaller steps because of the adjustment of parameter, in such a way to converge.

The invention claimed is:

1. Generation system (100) of synthesized sound in music instruments; said system (100) comprising a first stage (1), a second stage (2) and a third stage (3), the first stage (1) comprising:

features extraction means (10) configured in such a way to extract features (F) from an input raw sound ($S_{IN}$);

a plurality of neural networks (11), wherein each neural network is configured in such a way to evaluate the parameters of said features (F) and emit output evaluated parameters ($P^*_1, \ldots P^*_M$), the second stage (2) comprising:

a plurality of physical model creation means (20), wherein each physical model creation means (20) receives said evaluated parameters ($P^*_1, \ldots P^*_M$) as input in order to obtain a plurality of physical models ($M_1, \ldots M_M$) configured in such a way to generate sounds ($S_1, \ldots S_M$) as output, a plurality of metric evaluation means (21), wherein each metric evaluation means (21) receives the sound of a physical model as input and compares it with a target sound ($S_T$) in such a way as to generate a distance ($d_1, \ldots d_M$) between the sound of the physical model and the target sound as output, selection means (22) that receive the distances ($d_1, \ldots d_M$) calculated by said metric evaluation means (21) as input and select the parameters ($P^*_i$) of the physical model, the sound of which has the lowest distance from the target sound, the third stage (3) comprising:

a memory (30) wherein the parameters ($P^*_i$) selected in the second stage are stored, physical model creation means (31) that receive the parameters ($P^*_i$) from the memory (30) and create a physical model ($M_i$) that emits a sound ($S_i$), metric evaluation means (32) that receive the sound of the physical model of the third stage and compare it with a target sound ($S_T$), in such a way to calculate a distance (di) between the sound of the physical model of the third stage and the target sound, perturbation means (34) that modify the parameters stored in said memory (30) in such a way to obtain perturbed parameters ($P'_i$) that are sent to said physical model creation means (31) to create physical models with the perturbed parameters, selection means (33) that receive the distances calculated by said metric evaluation means (32) of the third stage as input and select final parameters ($P_i$) of the physical model with the lowest distance, said system (100) also comprising a sound generator (106) that receives said final parameters ($P_i$) and generates a synthesized sound ($S_{OUT}$) as output.

2. Generation method of synthesized sound in music instruments, comprising the following steps:

extraction of features (F) from an input raw sound ($S_{IN}$);

evaluation of parameters of said features (F) by means of a plurality of neural networks (11) in such a way as to generate evaluated parameters ($P^*_1, \ldots P^*_M$) as output, creation of a plurality of physical models ($M_1, \ldots M_M$) with said evaluated parameters ($P^*_1, \ldots P^*_M$) wherein each physical model emits a sound ($S_1, \ldots S_M$) as output, metric evaluation (21) of each sound ($S_1, \ldots S_M$) emitted by each physical mode, and comparison with a target sound ($S_T$) in such a way to obtain a distance ($d_1, \ldots d_M$) between the sound of the physical model and the target sound, calculation of the lowest distance ($d_i$) and selection of the parameters ($P^*_i$) of the physical model, whose sound has the lowest distance from the target sound, storage of the selected parameters ($P^*_i$), creation of a physical model ($M_i$) with the stored parameters ($P^*_i$), wherein said physical model ($M_i$) emits a sound ($S_i$), metric evaluation of the sound ($S_i$) of the physical model that is compared with a target sound ($S_T$), in such a way to calculate a distance (di) between the sound of the physical model and the target sound, perturbation of the parameters stored in said memory (30) in such a way to obtain perturbed parameters ($P'_i$) and creation of physical models with the perturbed parameters, metric evaluation of the sound of the physical models with perturbed parameters in such a way as to calculate the distances between the sounds of the physical models with perturbed parameters and the target sound, calculation of the lowest distance and selection of the final parameters ($P_i$) of the physical model with the lowest distance, generation of a synthesized sound ($S_{OUT}$) as output by means of a sound generator (106) that receives said final parameters ($P_i$).

* * * * *